United States Patent [19]

Nagahara

[11] Patent Number: 4,615,174

[45] Date of Patent: Oct. 7, 1986

[54] FLUID CIRCUIT SYSTEM FOR OPERATING BIDIRECTIONAL HYDRAULIC MOTOR

[75] Inventor: Yoshikazu Nagahara, Yokohama, Japan

[73] Assignee: Kabushiki Kaisha Komatsu Seisakusho, Tokyo, Japan

[21] Appl. No.: 698,481

[22] Filed: Feb. 5, 1985

[30] Foreign Application Priority Data

Feb. 10, 1984 [JP] Japan ..... 59-016642[U]

[51] Int. Cl.[4] ..... F15B 15/00

[52] U.S. Cl. ..... 60/442; 60/468

[58] Field of Search ..... 60/442, 468

[56] References Cited

FOREIGN PATENT DOCUMENTS 55-142105 6/1980 Japan .

*Primary Examiner*—Gerald A. Michalsky

*Attorney, Agent, or Firm*—Armstrong, Nikaido, Marmelstein & Kubovcik

[57] ABSTRACT

A fluid pressure control circuit for operating a bidirectional hydraulic motor comprises first and second main conduits for selectively supplying the pressurized fluid delivered by a main hydraulic pump through a pilot fluid pressure operated three-position directional control valve and via a brake valve device into first and second ports of the bidirectional hydraulic motor; two pilot fluid supply conduits located in parallel relationship with each other for selectively supplying the pressurized fluid delivered by an auxiliary hydraulic pump as a pilot fluid pressure through a three-position directional control valve into the left and right pressure receiving portions of said pilot fluid pressure operated three-position directional control valve; a conduit for selectively supplying the pressurized fluid delivered by the auxiliary hydraulic motor through a solenoid operated control valve into the pressure chamber of a gyratory brake device; and a conduit for short-circuiting said two pilot fluid supply conduits by means of a solenoid operated neutral valve. The solenoid of said solenoid operated control valve and that of said solenoid operated neutral valve are electrically connected so as to be energized and deenergized in synchronous relationship.

2 Claims, 1 Drawing Figure

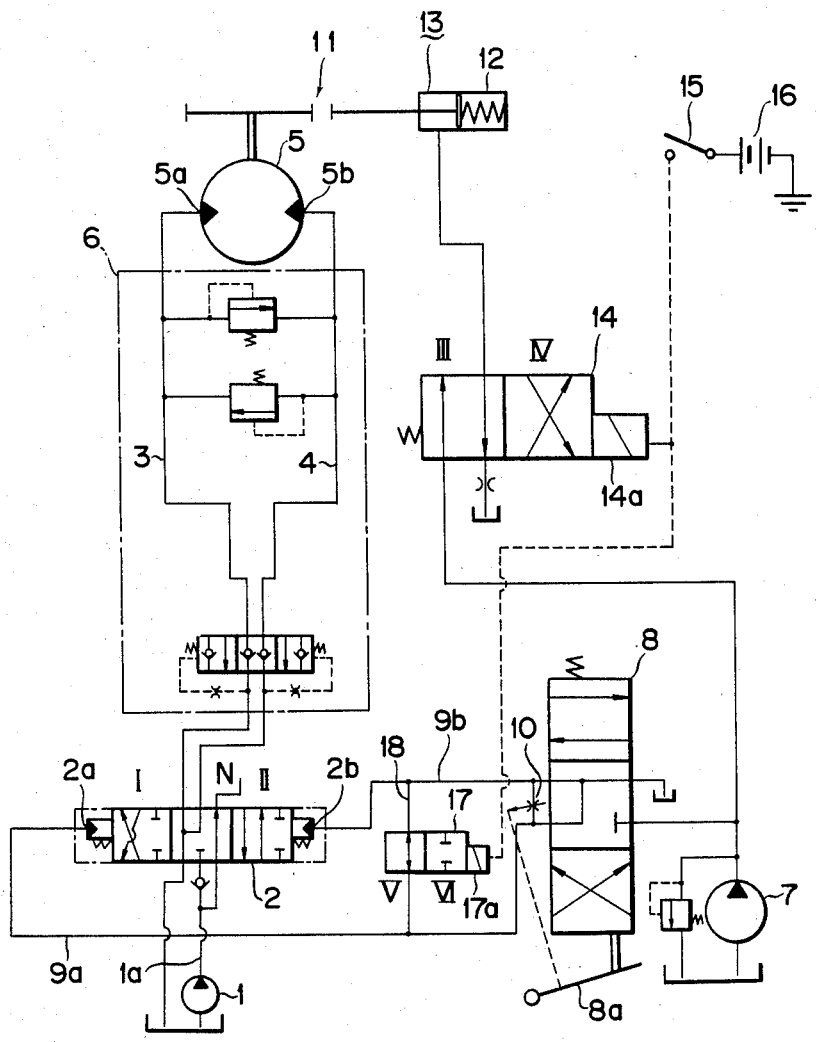
11
13
12
15
16
5
5a
5b
6
14
III
IV
3
4
14a
8
9b
10
18
2a
I
N
II
2b
17
2
V
VI
17a
7
9a
1a
1
8a

FLUID CIRCUIT SYSTEM FOR OPERATING BIDIRECTIONAL HYDRAULIC MOTOR

BACKGROUND OF THE INVENTION

1. Field of the Invention:

This invention relates to a fluid circuit system for operating a bidirectional hydraulic motor adapted, for example, to drive or gyrate the upper vehicle body of an earthmover such as, for example, a power shovel loader etc.

2. Description of the Prior Art:

In Japanese Patent Application Provisional Publication No. 55-142105, there is disclosed a fluid circuit system for operating a bidirectional hydraulic motor, comprising two main conduits located in parallel relationship with each other for supplying the fluid under pressure delivered by a main hydraulic pump through a directional control valve into the bidirectional hydraulic motor; a gyratory brake means of mechanical type for braking the hydraulic motor adapted to be actuated by the resilient force of a spring and also released by the fluid pressure; and a conduit connecting a pressure chamber of said gyratory brake means to an auxiliary pressurized fluid supply source through a changeover or control valve, said control valve being adapted to be held normally at a cut-off position and also changed over, when actuated, to a communicating position by the action of the pressurized fluid supplied through pilot conduits by the main hydraulic pump into said bidirectional hydraulic motor or by the action of the pressurized fluid delivered through pilot conduits by an auxiliary hydraulic pump adapted to be driven by said bidirectional hydraulic motor, the arrangement being made such that when said bidirectional hydraulic motor is driven or rotated said gyratory brake means is released, whilst when rotation of said hydraulic motor is stopped said brake means is rendered operative to effect a brake action.

This hydraulic circuit system is advantageous in that since it is capable of effecting a mechanical brake action when the bidirectional hydraulic motor is stopped the gyratory upper unit can be held at a desired angular position; however, it is disadvantageous in that since, in this fluid circuit, the gyratory brake means is arranged to be released by the action of the pressurized fluid supplied into the hydraulic motor or by the fluid under pressure delivered by the auxiliary hydraulic pump, and is rendered operative to effect a brake action by the resilient force of a spring when the pressure of the pressurized fluid is lowered, the gyratory brake means cannot be actuated to effect a brake action or released at a desired angular position.

SUMMARY OF THE INVENTION

The present invention has for its object to provide a fluid circuit system for operating a bidirectional hydraulic motor which can be used for rendering the gyratory brake means operative to effect a brake action or releasing the same and which is arranged to prevent the hydraulic motor when the gyratory brake means is under brake action from idly rotating or driving.

To achieve the above-mentioned object, according to the present invention, there is provided a fluid pressure control circuit system for operating a bidirectional hydraulic motor, comprising a main hydraulic pump; first and second main conduits located in parallel relationship with each other and arranged to be connected selectively through a pilot fluid pressure operated three-position directional control valve to the delivery path of said main hydraulic pump; a bidirectional hydraulic motor having first and second ports formed therein and which are adapted to be connected selectively through a brake valve with said first and second main conduits; a gyratory brake means adapted to be actuated to apply a braking force to said main hydraulic motor by the resilient force of its spring and released by a predetermined fluid pressure introduced therein; a conduit for selectively connecting a pressure chamber of said gyratory brake means to either one of drain and an auxiliary hydraulic pump through a solenoid control valve, said solenoid control valve being adapted to be held normally at a draining position and also changed over to a communicating position when its solenoid is energized; left and right pilot fluid supply conduits located in parallel relationship with each other, said pilot fluid supply conduits being connected through a three-position directional control valve with said auxiliary hydraulic pump and also connected with the left and right pressure receiving portions of said pilot fluid pressure operated three-position directional control valve; a conduit for short-circuiting said pilot fluid supply conduits through a solenoid operated neutral valve, said solenoid operated neutral valve being adapted to be held normally at a communicating position and also changed over to a cut-off position when its solenoid is energized; and a switch for connecting the solenoid of said solenoid control valve and the solenoid of said solenoid operated neutral valve with a power supply.

BRIEF DESCRIPTION OF THE DRAWINGS

The above and many other advantages, features and additional objects of the present invention will become apparent to those skilled in the art upon making reference to the following detailed description and accompanying drawings in which a preferred structural embodiment incorporating the principles of the present invention is shown by way of illustrative example.

The accompanying drawing is a schematic fluid circuit diagram showing an embodiment of the present invention.

DETAILED DESCRIPTION OF THE INVENTION

A delivery conduit 1*a* extending from a hydraulic pump 1 is controlled by a directional control valve 2 to be connected selectively with either one of first and second main conduits 3 and 4 which are connected in turn with first and second ports 5*a* and 5*b*, respectively, of a hydraulic motor 5. Further, a brake valve 6 of a well-known type is connected between the first and second main conduits 3 and 4.

The above-mentioned directional control valve 2 is a well-known pilot fluid pressure operated three-position directional control valve adapted to be held normally at a neutral position N and also changed over to a position I for turning the upper vehicle body counterclockwise to supply fluid under pressure into the first main conduit 3 when a pilot fluid pressure is supplied into the left pressure receiving portion 2*a* and which is further changed over to another position II for turning the upper vehicle body clockwise to supply fluid under pressure into the second main circuit 4 when the pilot fluid pressure is supplied into the right pressure receiv-

BEST AVAILABLE COPY ing portion 2b. Connected with the left and right pressure receiving portions 2a and 2b are left and right pilot fluid supply conduits 9a 9b, respectively, which are controlled by means of a directional control valve 8 to be selectively supplied with the pressurized fluid delivered by an auxiliary hydraulic pump 7.

The above-mentioned directional control valve 8 is a well-known three-position control valve, and a variable restrictor or orifice 10 interlocked with a lever 8a attached to the valve 8 is connected between the left and right pilot fluid supply conduits 9a and 9b so that the pressurized fluid whose pressure is proportional to the stroke of the lever 8a may be supplied selectively into either one of the pilot fluid supply conduits or paths 9a and 9b. This directional control valve is a so-called POC valve.

Reference numeral 11 denotes a gyratory brake means adapted to be actuated by the resilient force of a spring 12 to effect a brake action and released when pressurized fluid is supplied into its pressure chamber 12 to overcome the force of the spring 12.

The above-mentioned pressure chamber 13 is controlled by a solenoid operated control valve 14 so as to be connected selectively with either one of the delivery side and drain of the auxiliary hydraulic pump 7. The solenoid operated control valve 14 has a solenoid 14a which is connected by way of a switch 15 with a power supply 16. This solenoid operated control valve 14 is adapted to be held at a draining position III by the resilient force of its spring and also changed over to a communicating position IV when its solenoid 14a is energized.

Reference numeral 17 indicates a solenoid operated neutral valve installed in a short-circuiting path or conduit 18 which is connected between the left and right pilot fluid supply paths or conduits 9a and 9b. This solenoid operated neutral valve 17 has a solenoid 17a connected through the aforementioned switch 15 with the power supply 16, and is adapted to be held at a communicating position V by the resilient force of its spring, and also changed over to a cut-off or disconnecting position VI when the solenoid 17a is energized.

Thus, when the switch 15 is turned on so as to energize the solenoid 14a, the solenoid operated control valve 14 will occupy its communicating position IV to allow pressurized fluid to be supplied into the pressure chamber 13 thereby releasing the gyratory brake means 11 and permitting the solenoid operated neutral valve 17 to occupy its cut-off or disconnecting position VI.

Therefore, if the directional control valve is manipulated to supply the pilot fluid pressure selectively into either one of the pilot fluid supply path 9a and the right pilot fluid supply path 9b so as to allow the pilot fluid operated three-position directional control valve 2 to occupy the position I for turning counterclockwise or the position II for turning clockwise, the pressurized fluid delivered by the hydraulic pump 1 is supplied selectively into either the first main conduit 3 or the second main conduit 4 thereby rotating the hydraulic motor 5 counterclockwise or clockwise to turn the gyratory unit or the upper vehicle body, not shown, counterclockwise or clockwise.

When the switch 15 is turned off from the aforementioned state, the solenoid 14a is deenergized, and in consequence the solenoid operated control valve 14 will occupy its draining position III. As a result, the pressure chamber 13 is connected to the drain so that the gyratory brake means 11 is actuated to apply a braking force to the hydraulic motor 5 thereby locking the latter.

Thus, the gyratory brake means 11 can be actuated to effect a brake action or released as desired by turning the switch 15 on or off.

Further, when the gyratory brake means 11 is actuated to effect a brake action; that is, when the switch 15 is turned off, the neutral valve will occupy its communicating position V to short-circuit the left and right pilot fluid supply paths or conduits 9a and 9b. Therefore, even if the directional control valve 8 is manipulated for change-over, the pilot fluid pressure operated three-position directional control valve 2 cannot be changed from its neutral position N over to its positions I and II. Therefore, when the gyratory brake means 11 is under braking condition, it is possible to prevent rotation of the hydraulic motor 5.

It is to be understood that the foregoing description is merely illustrative of a preferred embodiment of the present invention, and that the present invention is not to be limited thereto, but is to be determined by the scope of the appended claims.

What is claimed is:

1. A fluid pressure control circuit system comprising a main hydraulic pump; first and second main conduits arranged in parallel relationship with each other and arranged to be connected selectively through a pilot fluid pressure operated three-position directional control valve to the delivery path of said main hydraulic pump; a bidirectional hydraulic motor having first and second ports formed therein and which are adapted to be connected selectively through a brake valve means with said first and second main conduits; a gyratory brake means adapted to be actuated to apply a braking force to said main hydraulic motor by the resilient force of its spring and released by a predetermined fluid pressure introduced therein; a conduit for selectively connecting a pressure receiving chamber of said gyratory brake means to either one of drain and an auxiliary hydraulicly pump through a solenoid operated control valve, said solenoid operated control valve being adapted to be held normally at a draining position and also changed over to a communicating position when its solenoid is energized; left and right pilot fluid supply conduits located in parallel relationship with each other, said pilot fluid supply conduits being connected through a three-position directional control valve with said auxiliary hydraulic pump and also connected with the left and right pressure receiving portions of said pilot fluid pressure operated three-position directional control valve; a conduit for short-circuiting said pilot fluid supply conduits through a solenoid operated neutral valve, said solenoid operated neutral valve being adapted to be held normally at a communicating position and also changed over to a cut-off position when its solenoid is energized; and a switch for connecting the solenoid of said solenoid control valve and the solenoid of said solenoid operated neutral valve with a power supply.

2. The system as claimed in claim 1 wherein both said solenoids of said solenoid operated control valve and said solenoid operated neutral valve are energized and deenergized in synchronous relationship.

* * * * *